US009435340B2

(12) United States Patent
Doepker et al.

(10) Patent No.: US 9,435,340 B2
(45) **Date of Patent: *Sep. 6, 2016**

(54) SCROLL COMPRESSOR WITH VARIABLE VOLUME RATIO PORT IN ORBITING SCROLL

(71) Applicant: Emerson Climate Technologies, Inc., Sidney, OH (US)

(72) Inventors: Roy J. Doepker, Lima, OH (US); Michael M. Perevozchikov, Tipp City, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 221 days.

This patent is subject to a terminal disclaimer.

(21) Appl. No.: 14/073,293

(22) Filed: Nov. 6, 2013

(65) Prior Publication Data

US 2014/0154124 A1 Jun. 5, 2014

Related U.S. Application Data

(60) Provisional application No. 61/731,645, filed on Nov. 30, 2012.

(51) Int. Cl.
*F01C 1/02* (2006.01)
*F01C 1/063* (2006.01)
(Continued)

(52) U.S. Cl.
CPC ..... *F04C 18/0207* (2013.01); *F04C 18/0215* (2013.01); *F04C 18/0261* (2013.01); *F04C 28/16* (2013.01)

(58) Field of Classification Search
CPC F04C 18/0215; F04C 18/0261; F04C 28/16; F04C 18/0297
USPC ..... 418/55.1–55.6
See application file for complete search history.

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1158944 A 9/1997
CN 1158945 A 9/1997
(Continued)

OTHER PUBLICATIONS

International Search Report regarding Application No. PCT/US2013/070981, mailed Mar. 4, 2014.
(Continued)

*Primary Examiner* — Jesse Bogue
*Assistant Examiner* — Deming Wan
(74) *Attorney, Agent, or Firm* — Harness, Dickey & Pierce, P.L.C.

(57) ABSTRACT

A compressor may include a first scroll member, a second scroll member and a drive shaft. The first scroll member may include a first end plate defining a first discharge port and a first spiral wrap extending from the first end plate. The second scroll member may include a second end plate defining a first variable volume ratio port and a second spiral wrap extending from the second end plate and meshingly engaged with the first spiral wrap and forming compression pockets. The variable volume ratio port may be located radially outward relative to the first discharge port and in communication with a first compression pocket. The drive shaft may be engaged with the second scroll member and driving orbital displacement of the second scroll member relative to the first scroll member.

21 Claims, 7 Drawing Sheets

(51) Int. Cl.

| | |
|---|---|
| ***F03C 2/02*** | (2006.01) |
| ***F04C 2/02*** | (2006.01) |
| ***F04C 18/02*** | (2006.01) |
| ***F04C 28/16*** | (2006.01) |

(56) References Cited

U.S. PATENT DOCUMENTS

| | | | | |
|---|---|---|---|---|
| 4,382,370 | A | | 5/1983 | Suefuji et al. |
| 4,383,805 | A | | 5/1983 | Teegarden et al. |
| 4,389,171 | A | | 6/1983 | Eber et al. |
| 4,475,360 | A | | 10/1984 | Suefuji et al. |
| 4,497,615 | A | | 2/1985 | Griffith |
| 4,545,742 | A | | 10/1985 | Schaefer |
| 4,609,329 | A | | 9/1986 | Pillis et al. |
| 4,696,630 | A | | 9/1987 | Sakata et al. |
| 4,727,725 | A | | 3/1988 | Nagata et al. |
| 4,774,816 | A | | 10/1988 | Uchikawa et al. |
| 4,818,195 | A | | 4/1989 | Murayama et al. |
| 4,846,633 | A | | 7/1989 | Suzuki et al. |
| 4,877,382 | A | | 10/1989 | Caillat et al. |
| 4,886,425 | A | | 12/1989 | Itahana et al. |
| 4,940,395 | A | | 7/1990 | Yamamoto et al. |
| 5,055,010 | A | | 10/1991 | Logan |
| 5,059,098 | A | | 10/1991 | Suzuki et al. |
| 5,071,323 | A | | 12/1991 | Sakashita et al. |
| 5,074,760 | A | | 12/1991 | Hirooka et al. |
| 5,080,056 | A | | 1/1992 | Kramer et al. |
| 5,085,565 | A | * | 2/1992 | Barito ..... 418/55.4 |
| RE34,148 | E | | 12/1992 | Terauchi et al. |
| 5,169,294 | A | | 12/1992 | Barito |
| 5,192,195 | A | | 3/1993 | Iio et al. |
| 5,193,987 | A | | 3/1993 | Iio et al. |
| 5,240,389 | A | | 8/1993 | Oikawa et al. |
| 5,253,489 | A | | 10/1993 | Yoshii |
| 5,356,271 | A | | 10/1994 | Miura et al. |
| 5,451,146 | A | | 9/1995 | Inagaki et al. |
| 5,482,637 | A | | 1/1996 | Rao et al. |
| 5,551,846 | A | | 9/1996 | Taylor et al. |
| 5,557,897 | A | | 9/1996 | Kranz et al. |
| 5,562,426 | A | | 10/1996 | Watanabe et al. |
| 5,577,897 | A | | 11/1996 | Inagaki et al. |
| 5,607,288 | A | | 3/1997 | Wallis et al. |
| 5,613,841 | A | | 3/1997 | Bass et al. |
| 5,639,225 | A | | 6/1997 | Matsuda et al. |
| 5,640,854 | A | | 6/1997 | Fogt et al. |
| 5,674,058 | A | | 10/1997 | Matsuda et al. |
| 5,678,985 | A | | 10/1997 | Brooke et al. |
| 5,722,257 | A | | 3/1998 | Ishii et al. |
| 5,741,120 | A | | 4/1998 | Bass et al. |
| 5,855,475 | A | | 1/1999 | Fujio et al. |
| 5,885,063 | A | | 3/1999 | Makino et al. |
| 5,993,171 | A | | 11/1999 | Higashiyama |
| 5,993,177 | A | | 11/1999 | Terauchi et al. |
| 6,047,557 | A | | 4/2000 | Pham et al. |
| 6,086,335 | A | | 7/2000 | Bass et al. |
| 6,095,765 | A | | 8/2000 | Khalifa |
| 6,102,671 | A | | 8/2000 | Yamamoto et al. |
| 6,123,517 | A | | 9/2000 | Brooke et al. |
| 6,123,528 | A | | 9/2000 | Sun et al. |
| 6,132,179 | A | | 10/2000 | Higashiyama |
| 6,139,287 | A | | 10/2000 | Kuroiwa et al. |
| 6,139,291 | A | | 10/2000 | Perevozchikov |
| 6,149,401 | A | | 11/2000 | Iwanami et al. |
| 6,164,940 | A | | 12/2000 | Terauchi et al. |
| 6,176,686 | B1 | | 1/2001 | Wallis et al. |
| 6,202,438 | B1 | | 3/2001 | Barito |
| 6,210,120 | B1 | | 4/2001 | Hugenroth et al. |
| 6,213,731 | B1 | | 4/2001 | Doepker et al. |
| 6,231,316 | B1 | | 5/2001 | Wakisaka et al. |
| 6,273,691 | B1 | | 8/2001 | Morimoto et al. |
| 6,293,767 | B1 | | 9/2001 | Bass |
| 6,293,776 | B1 | | 9/2001 | Hahn et al. |
| 6,322,340 | B1 | * | 11/2001 | Itoh et al. ..... 418/55.2 |
| 6,350,111 | B1 | | 2/2002 | Perevozchikov et al. |
| 6,379,123 | B1 | | 4/2002 | Makino et al. |
| 6,412,293 | B1 | | 7/2002 | Pham et al. |
| 6,413,058 | B1 | | 7/2002 | Williams et al. |
| 6,419,457 | B1 | | 7/2002 | Seibel et al. |
| 6,428,286 | B1 | | 8/2002 | Shimizu et al. |
| 6,454,551 | B2 | | 9/2002 | Kuroki et al. |
| 6,457,948 | B1 | | 10/2002 | Pham |
| 6,464,481 | B2 | | 10/2002 | Tsubai et al. |
| 6,478,550 | B2 | | 11/2002 | Matsuba et al. |
| 6,506,036 | B2 | | 1/2003 | Tsubai et al. |
| 6,537,043 | B1 | | 3/2003 | Chen |
| 6,544,016 | B2 | | 4/2003 | Gennami et al. |
| 6,558,143 | B2 | | 5/2003 | Nakajima et al. |
| 6,589,035 | B1 | | 7/2003 | Tsubono et al. |
| 6,679,683 | B2 | | 1/2004 | Seibel et al. |
| 6,715,999 | B2 | | 4/2004 | Ancel et al. |
| 6,769,881 | B2 | | 8/2004 | Lee |
| 6,769,888 | B2 | | 8/2004 | Tsubono et al. |
| 6,773,242 | B1 | | 8/2004 | Perevozchikov |
| 6,817,847 | B2 | | 11/2004 | Agner |
| 6,821,092 | B1 | | 11/2004 | Gehret et al. |
| 6,863,510 | B2 | | 3/2005 | Cho |
| 6,881,046 | B2 | | 4/2005 | Shibamoto et al. |
| 6,884,042 | B2 | | 4/2005 | Zili et al. |
| 6,893,229 | B2 | | 5/2005 | Choi et al. |
| 6,913,448 | B2 | | 7/2005 | Liang et al. |
| 6,984,114 | B2 | | 1/2006 | Zili et al. |
| 7,018,180 | B2 | | 3/2006 | Koo |
| 7,029,251 | B2 | | 4/2006 | Chang et al. |
| 7,118,358 | B2 | | 10/2006 | Tsubono et al. |
| 7,137,796 | B2 | | 11/2006 | Tsubono et al. |
| 7,207,787 | B2 | | 4/2007 | Liang et al. |
| 7,229,261 | B2 | | 6/2007 | Morimoto et al. |
| 7,255,542 | B2 | | 8/2007 | Lifson et al. |
| 7,261,527 | B2 | | 8/2007 | Alexander et al. |
| 7,311,740 | B2 | | 12/2007 | Williams et al. |
| 7,344,365 | B2 | | 3/2008 | Takeuchi et al. |
| 7,354,259 | B2 | | 4/2008 | Tsubono et al. |
| 7,364,416 | B2 | | 4/2008 | Liang et al. |
| 7,371,057 | B2 | | 5/2008 | Shin et al. |
| 7,393,190 | B2 | | 7/2008 | Lee et al. |
| 7,404,706 | B2 | | 7/2008 | Ishikawa et al. |
| 7,547,202 | B2 | | 6/2009 | Knapke |
| 7,717,687 | B2 | | 5/2010 | Reinhart |
| 7,771,178 | B2 | | 8/2010 | Perevozchikov et al. |
| 7,802,972 | B2 | | 9/2010 | Shimizu et al. |
| 7,891,961 | B2 | | 2/2011 | Shimizu et al. |
| 7,967,583 | B2 | | 6/2011 | Stover et al. |
| 7,976,295 | B2 | | 7/2011 | Stover et al. |
| 7,988,433 | B2 | | 8/2011 | Akei et al. |
| 8,517,703 | B2 | | 8/2013 | Doepker |
| 8,585,382 | B2 | | 11/2013 | Akei et al. |
| 9,127,677 | B2 | | 9/2015 | Doepker |
| 9,249,802 | B2 | | 2/2016 | Doepker et al. |
| 2001/0010800 | A1 | | 8/2001 | Kohsokabe et al. |
| 2002/0039540 | A1 | | 4/2002 | Kuroki et al. |
| 2003/0186060 | A1 | | 10/2003 | Rao |
| 2004/0136854 | A1 | | 7/2004 | Kimura et al. |
| 2004/0146419 | A1 | | 7/2004 | Kawaguchi et al. |
| 2004/0184932 | A1 | | 9/2004 | Lifson |
| 2004/0197204 | A1 | | 10/2004 | Yamanouchi et al. |
| 2005/0019177 | A1 | | 1/2005 | Shin et al. |
| 2005/0019178 | A1 | | 1/2005 | Shin et al. |
| 2005/0053507 | A1 | | 3/2005 | Takeuchi et al. |
| 2005/0201883 | A1 | | 9/2005 | Clendenin et al. |
| 2005/0214148 | A1 | | 9/2005 | Ogawa et al. |
| 2006/0099098 | A1 | | 5/2006 | Lee et al. |
| 2006/0228243 | A1 | | 10/2006 | Sun et al. |
| 2006/0233657 | A1 | | 10/2006 | Bonear et al. |
| 2007/0036661 | A1 | | 2/2007 | Stover |
| 2007/0110604 | A1 | | 5/2007 | Peyton |
| 2007/0130973 | A1 | | 6/2007 | Lifson et al. |
| 2008/0159892 | A1 | | 7/2008 | Huang et al. |
| 2008/0196445 | A1 | | 8/2008 | Lifson et al. |
| 2008/0223057 | A1 | | 9/2008 | Lifson et al. |
| 2008/0305270 | A1 | | 12/2008 | Uhlianuk et al. |
| 2009/0068048 | A1 | | 3/2009 | Stover et al. |
| 2009/0071183 | A1 | | 3/2009 | Stover et al. |
| 2009/0297377 | A1 | | 12/2009 | Stover et al. |
| 2009/0297378 | A1 | | 12/2009 | Stover et al. |

(56) References Cited

U.S. PATENT DOCUMENTS

| | | | |
|---|---|---|---|
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |

FOREIGN PATENT DOCUMENTS

| | | | |
|---|---|---|---|
| CN | 1680720 | A | 10/2005 |
| CN | 1702328 | A | 11/2005 |
| CN | 1963214 | A | 5/2007 |
| CN | 101761479 | A | 6/2010 |
| CN | 101806302 | A | 8/2010 |
| EP | 1182353 | A1 | 2/2002 |
| EP | 1241417 | A1 | 9/2002 |
| EP | 1382854 | A2 | 1/2004 |
| JP | 60259794 | | 12/1985 |
| JP | 63-205482 | | 8/1988 |
| JP | 03081588 | A | 4/1991 |
| JP | H07-293456 | A | 11/1995 |
| JP | 08334094 | A | 12/1996 |
| JP | H09-177689 | A | 7/1997 |
| JP | 11107950 | | 4/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| KR | 101987000001 | | 5/1985 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| WO | WO-2007046810 | A2 | 4/2007 |

OTHER PUBLICATIONS

Written Opinion of the International Searching Authority regarding Application No. PCT/US2013/070981, mailed Mar. 4, 2014.
International Search Report regarding Application No. PCT/US2013/069456, mailed Feb. 18, 2014.
Written Opinion of the International Searching Authority regarding Application No. PCT/US2013/069456, mailed Feb. 18, 2014.
International Search Report regarding Application No. PCT/US2013/070992, mailed Feb. 25, 2014.
Written Opinion of the International Searching Authority regarding Application No. PCT/US2013/070992, mailed Feb. 25, 2014.
China Office Action regarding Application No. 201080020243.1 dated Nov. 5, 2013. Translation provided by Unitalen Attorneys At Law.
International Search Report regarding Application No. PCT/US2013/069462, mailed Feb. 21, 2014.
Written Opinion of the Internation Searching Authority regarding Application No. PCT/US2013/069462, mailed Feb. 21, 2014.
U.S. Appl. No. 13/948,458, filed Jul. 23, 2013.
U.S. Appl. No. 13/948,653, filed Jul. 23, 2013.
U.S. Appl. No. 14/073,246, filed Nov. 6, 2013.
International Search Report regarding Application No. PCT/US2011/025921, mailed Oct. 7, 2011.
Written Opinion of the International Search Authority regarding Application No. PCT/US2011/025921, mailed Oct. 7, 2011.
Written Opinion of the International Searching Authority regarding Application No. PCT/US2010/030248, mailed Nov. 26, 2010.
International Search Report regarding Application No. PCT/US2010/030248, mailed Nov. 26, 2010.
U.S. Office Action regarding U.S. Appl. No. 13/181,065 mailed Nov. 9, 2012.
U.S. Appl. No. 14/073,293, filed Nov. 6, 2013.
International Search Report regarding Application No. PCT/US2013/051678, mailed Oct. 21, 2013.
Written Opinion of the International Searching Authority regarding Application No. PCT/US2013/051678, mailed Oct. 21, 2013.
U.S. Appl. No. 14/060,240, filed Oct. 22, 2013.
U.S. Office Action regarding U.S. Appl. No. 11/645,288 mailed Nov. 30, 2009.
Extended European Search Report regarding Application No. EP07254962 dated Mar. 12, 2008.
First China Office Action regarding Application No. 200710160038.5 dated Jul. 8, 2010.
China Office Action regarding Application No. 200710160038.5 dated Jan. 31, 2012.
Search Report regarding European Patent Application No. 10762374.6-1608/2417356 PCT/US2010030248, dated Jun. 16. 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
First Office Action regarding Chinese Application No. 201380059666.8, dated Apr. 5, 2016. Translation provided by Unitalen Attorneys At Law.
First Office Action regarding Chinese Application No. 201380062614.6, dated Apr. 5, 2016. Translation provided by Unitalen Attorneys At Law.
Interview Summary regarding U.S. Appl. No. 14/060,240, mailed Dec. 1, 2015.
Office Action regarding Chinese Patent Application No. 201410460792.0, dated Feb. 25, 2016. Translation provided by Unitalen Attorneys at Law.
Office Action regarding Chinese Patent Application No. 201410461048.2, dated Nov. 30, 2015. Translation provided by Unitalen Attorneys at Law.
Office Action regarding U.S. Appl. No. 14/081,390, mailed Mar. 27, 2015.
Restriction Requirement regarding U.S. Appl. No. 14/060,102, dated Mar. 16, 2016.
Restriction Requirement regarding U.S. Appl. No. 14/060,102, dated Oct. 7, 2015.
Second Office Action regarding China Application No. 201180010366.1 dated Dec. 31, 2014. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.

* cited by examiner

SCROLL COMPRESSOR WITH VARIABLE VOLUME RATIO PORT IN ORBITING SCROLL

CROSS-REFERENCE TO RELATED APPLICATIONS

This application claims the benefit of U.S. Provisional Application No. 61/731,645, filed on Nov. 30, 2012. The entire disclosure of the above application is incorporated herein by reference.

FIELD

The present disclosure relates to compressors, and more specifically to compressors having a variable volume ratio.

BACKGROUND

This section provides background information related to the present disclosure and is not necessarily prior art.

Scroll compressors include a variety of valve assemblies to control compressor discharge conditions. The valve assemblies may include numerous parts resulting in a complex assembly process. Additionally, some compressors may include multiple valve assemblies, further complicating assembly.

SUMMARY

This section provides a general summary of the disclosure, and is not a comprehensive disclosure of its full scope or all of its features.

In one form, the present disclosure provides a compressor that may include a first scroll member, a second scroll member and a drive shaft. The first scroll member may include a first end plate defining a first discharge port and a first spiral wrap extending from the first end plate. The second scroll member may include a second end plate defining a first variable volume ratio port and a second spiral wrap extending from the second end plate and meshingly engaged with the first spiral wrap and forming compression pockets. The variable volume ratio port may be located radially outward relative to the first discharge port and in communication with a first compression pocket. The drive shaft may be engaged with the second scroll member and driving orbital displacement of the second scroll member relative to the first scroll member.

In some embodiments, the second end plate may define a second discharge port and the first and second spiral wraps may define a central discharge pocket in communication with the first and second discharge ports.

In some embodiments, the compressor may include a variable volume ratio valve displaceable between a closed position and an open position. The variable volume ratio valve may isolate the variable volume ratio port from the discharge pocket when in the closed position and may provide communication between the first compression pocket and the discharge pocket via the variable volume ratio port when in the open position.

In some embodiments, a flow path may be defined from the first compression pocket to the first discharge port by the variable volume ratio port and the second discharge port when the variable volume ratio valve is in the open position.

In some embodiments, the second scroll member may include a drive hub extending from the second end plate and engaged with the drive shaft. The variable volume ratio valve may be located within the drive hub axially between the drive shaft and the second end plate.

In some embodiments, the compressor may include a valve housing located within the drive hub axially between the variable volume ratio valve and the drive shaft.

In some embodiments, a flow path may be defined between the second end plate and the valve housing from the variable volume ratio port to the second discharge port when the variable volume ratio valve is in the open position.

In some embodiments, the compressor may include a drive bearing surrounding an outer circumference of the drive shaft and located within an annular wall defined by the valve housing.

In some embodiments, the compressor may include a drive bearing surrounding an outer circumference of the drive shaft and located at an axial end of the valve housing opposite the second end plate.

In some embodiments, the valve housing may define a drive bearing surrounding an outer circumference of the drive shaft.

In some embodiments, the drive bearing may include an anti-wear coating.

In some embodiments, the variable volume ratio valve may define an annular body including a central aperture surrounding the second discharge port.

In some embodiments, the compressor may include a second valve and a shell housing the first and second scroll members and defining a discharge passage. The second valve may be in communication with the first discharge port and the discharge passage and may control communication between the discharge passage and the discharge pocket.

In some embodiments, the second scroll member may include first and second members coupled to one another with the variable volume ratio valve located axially between the first and second members. The first member may define a first portion of the second end plate and the second spiral wrap and the second member may define a second portion of the second end plate and a drive hub extending from the second portion and engaged with the drive shaft.

In some embodiments, the first member may define the second discharge port and the variable volume ratio port and a flow path may be defined between the first and second members from the variable volume ratio port to the second discharge port when the variable volume ratio valve is in the open position.

In some embodiments, the compressor may include a first variable volume ratio valve and a second variable volume ratio valve. The first and second variable volume ratio valves may be displaceable between open and closed positions independent from one another. The first variable volume ratio valve may selectively open the first variable volume ratio port and the second variable volume ratio valve may selectively open a second variable volume ratio port defined in the second end plate.

In some embodiments, the compressor may include a shell housing the first and second scroll members and a seal engaged with the first scroll member and the shell. The seal and the first scroll member may define a chamber in communication with a second compression pocket and providing axial biasing of the first scroll member relative to the shell.

In some embodiments, the second compression pocket may be located radially outward relative to the first compression pocket.

In another form, the present disclosure provides a compressor that may include a first scroll member, a second scroll member, a variable volume ratio valve, and a drive shaft. The first scroll member may include a first end plate defining a first discharge port and a first spiral wrap extending from the first end plate. The second scroll member may include a second end plate defining a variable volume ratio port, a drive hub extending from the second end plate and a second spiral wrap extending from the second end plate opposite the drive hub and meshingly engaged with the first spiral wrap and forming compression pockets and a discharge pocket. The variable volume ratio port may be located radially outward relative to the first discharge port and may be in communication with a first compression pocket. The variable volume ratio valve may be located within the drive hub and displaceable between a closed position and an open position. The variable volume ratio valve may isolate the variable volume ratio port from the discharge pocket when in the closed position and may provide communication between the first compression pocket and the discharge pocket via the variable volume ratio port when in the open position. The drive shaft may extend into the drive hub of the second scroll member and may drive orbital displacement of the second scroll member relative to the first scroll member.

In some embodiments, the second end plate may define a second discharge port extending into the drive hub and a flow path may be defined from the variable volume ratio port to the second discharge port through the drive hub when the variable volume ratio valve is in the open position.

In some embodiments, the compressor may include a monolithic valve housing located within the drive hub axially between the variable volume ratio valve and the drive shaft. The monolithic valve housing may define a drive bearing having an anti-wear coating.

In yet another form, the present disclosure provides a compressor that may include a first scroll member, a second scroll member, variable volume ratio valve, and a drive shaft. The first scroll member may include a first end plate defining a first discharge port and a first spiral wrap extending from the first end plate. The second scroll member may include first and second members coupled to one another and forming a second end plate defining a variable volume ratio port and a second spiral wrap extending from the second end plate and meshingly engaged with the first spiral wrap and forming compression pockets and a discharge pocket. The first member may define a first portion of the second end plate and the second spiral wrap. The second member may define a second portion of the second end plate and may include a drive hub extending therefrom. The variable volume ratio port may extend through the first member, may be located radially outward relative to the first discharge port and may be in communication with a first compression pocket. The variable volume ratio valve may be located axially between the first and second members and may be displaceable between a closed position and an open position. The variable volume ratio valve may isolate the variable volume ratio port from the discharge pocket when in the closed position and may provide communication between the first compression pocket and the discharge pocket via the variable volume ratio port when in the open position. The drive shaft may extend into the drive hub of the second scroll member and may drive orbital displacement of the second scroll member relative to the first scroll member.

In some embodiments, the first member may define a second discharge port and the discharge pocket may be in communication with the first and second discharge ports. The first and second members may define a flow path from the variable volume ratio port to the second discharge port when the variable volume ratio valve is in the open position.

In some embodiments, the compressor may include a monolithic valve housing located within the drive hub axially between the variable volume ratio valve and the drive shaft. The monolithic valve housing may define a drive bearing having an anti-wear coating.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
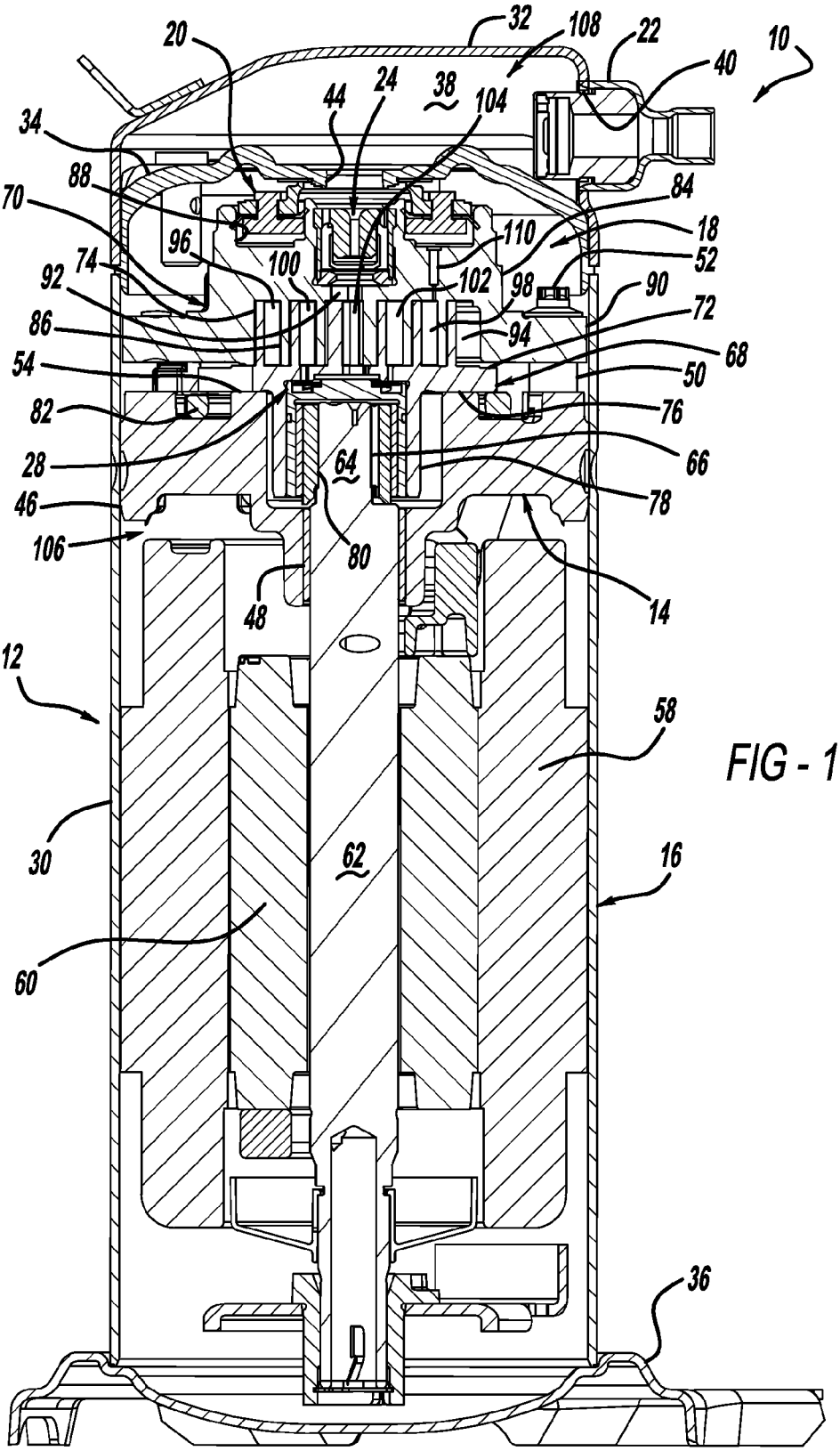
FIG. 1 is a section view of a compressor according to the present disclosure.

For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, a compressor 10 may include a hermetic shell assembly 12, a bearing housing assembly 14, a motor assembly 16, a compression mechanism 18, a seal assembly 20, a refrigerant discharge fitting 22, a discharge valve assembly 24, a suction gas inlet fitting (not shown), and a variable volume ratio (VVR) assembly 28. Shell assembly 12 may house bearing housing assembly 14, motor assembly 16, compression mechanism 18, and VVR assembly 28.

Shell assembly 12 may generally form a compressor housing and may include a cylindrical shell 30, an end cap 32 at the upper end thereof, a transversely extending partition 34, and a base 36 at a lower end thereof. End cap 32 and partition 34 may generally define a discharge chamber 38. Discharge chamber 38 may generally form a discharge muffler for compressor 10. While illustrated as including discharge chamber 38, it is understood that the present disclosure applies equally to direct discharge configurations. Refrigerant discharge fitting 22 may be attached to shell assembly 12 at opening 40 in end cap 32 and may define a first discharge passage. The suction gas inlet fitting (not shown) may be attached to shell assembly 12 at an opening (not shown). Partition 34 may define a second discharge passage 44 therethrough providing communication between compression mechanism 18 and discharge chamber 38.

Bearing housing assembly 14 may be affixed to shell 30 at a plurality of points in any desirable manner, such as staking. Bearing housing assembly 14 may include a main bearing housing 46, a bearing 48 disposed therein, bushings 50, and fasteners 52. Main bearing housing 46 may house bearing 48 therein and may define an annular flat thrust bearing surface 54 on an axial end surface thereof.

Motor assembly 16 may generally include a motor stator 58, a rotor 60, and a drive shaft 62. Motor stator 58 may be press fit into shell 30. Drive shaft 62 may be rotatably driven by rotor 60 and may be rotatably supported within bearing 48. Rotor 60 may be press fit on drive shaft 62. Drive shaft 62 may include an eccentric crank pin 64 having a flat 66 thereon.

Compression mechanism 18 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with annular flat thrust bearing surface 54 on main bearing housing 46. A cylindrical hub 78 may project downwardly from thrust surface 76 and may have a drive bushing 80 rotatably disposed therein. Drive bushing 80 may include an inner bore in which crank pin 64 is drivingly disposed. Crank pin flat 66 may drivingly engage a flat surface in a portion of the inner bore of drive bushing 80 to provide a radially compliant driving arrangement. An Oldham coupling 82 may be engaged with the orbiting and non-orbiting scrolls 68, 70 to prevent relative rotation therebetween.

Non-orbiting scroll 70 may include an end plate 84 defining a first discharge port 92 and having a spiral wrap 86 extending from a first side thereof, an annular recess 88 extending into a second side thereof opposite the first side, and a series of radially outwardly extending flanged portions 90 (FIG. 1) engaged with fasteners 52. Fasteners 52 may rotationally fix non-orbiting scroll 70 relative to main bearing housing 46 while allowing axial displacement of non-orbiting scroll 70 relative to main bearing housing 46. Discharge valve assembly 24 may be coupled to the end plate 84 of the non-orbiting scroll 70 and may generally prevent a reverse flow condition when the compressor 10 is shutdown. Spiral wraps 74, 86 may be meshingly engaged with one another defining pockets 94, 96, 98, 100, 102, 104. It is understood that pockets 94, 96, 98, 100, 102, 104 change throughout compressor operation.

A first pocket, pocket 94 in FIG. 1, may define a suction pocket in communication with a suction pressure region 106 of compressor 10 operating at a suction pressure ($P_s$) and a second pocket, pocket 104 in FIG. 1, may define a discharge pocket in communication with a discharge pressure region 108 of compressor 10 operating at a discharge pressure ($P_d$) via the first discharge port 92. Pockets intermediate the first and second pockets, pockets 96, 98, 100, 102 in FIG. 1, may form intermediate compression pockets operating at intermediate pressures between the suction pressure ($P_s$) and the discharge pressure ($P_d$). End plate 84 may additionally include a biasing passage 110 in fluid communication with one of the intermediate compression pockets.

Figure 2:
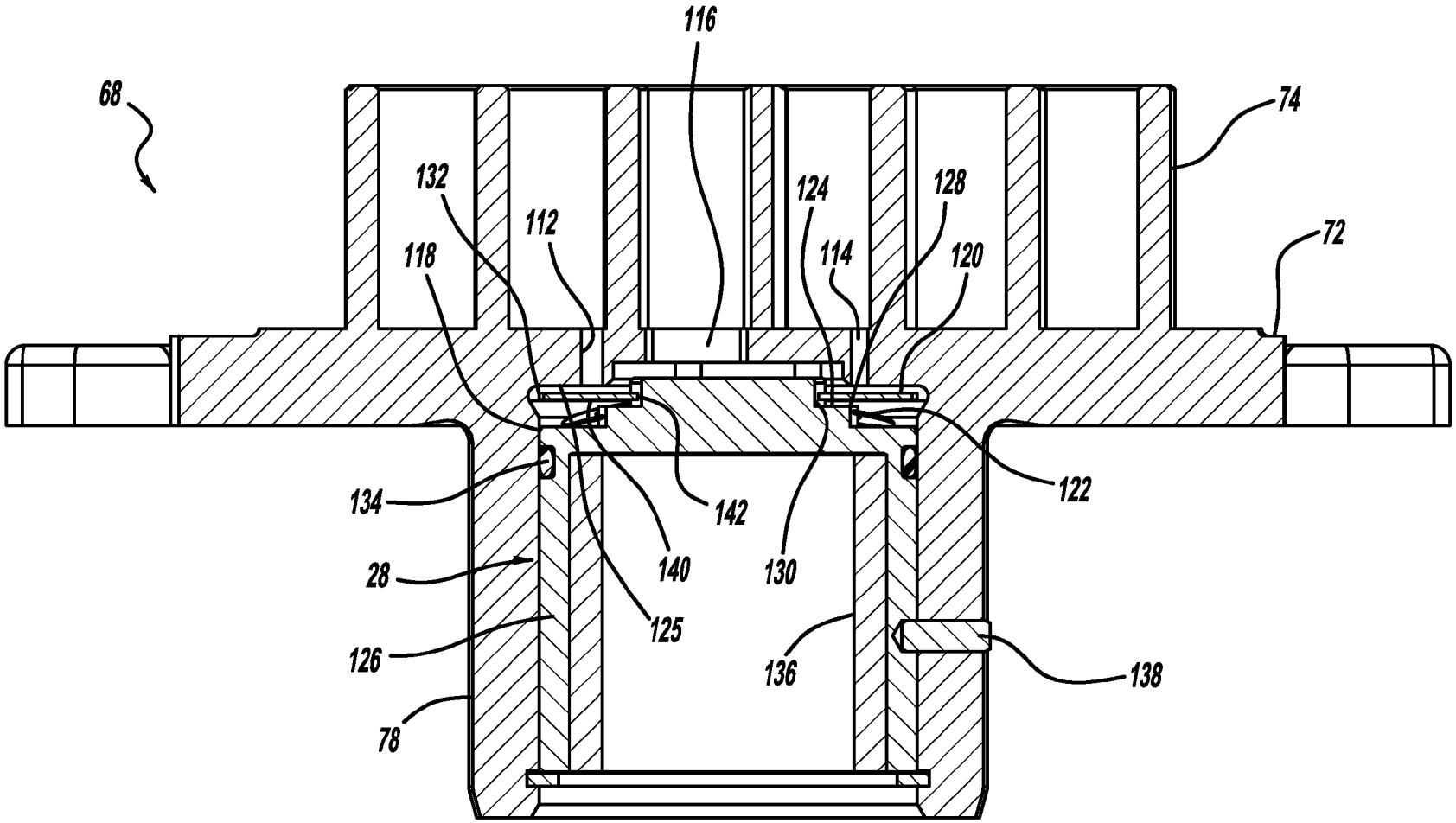
FIG. 2 is a section view of a portion of the compressor of FIG. 1.

With additional reference to FIG. 2, the end plate 72 of orbiting scroll 68 may include first and second VVR ports 112, 114 and a second discharge port 116. The first and second discharge ports 92, 116 may each be in communication with the discharge pocket. The first VVR ports 112 may be in communication with a first intermediate compression pocket and the second VVR ports 114 may be in communication with a second intermediate compression pocket. The first and second VVR ports 112, 114 may be located radially outward relative to the first and second discharge ports 92, 116. The biasing passage 110 may be in fluid communication with one of the intermediate compression pockets located radially outward from and operating at a lower pressure relative to the intermediate compression pockets in fluid communication with first and second VVR ports 112, 114.

VVR assembly 28 may include a valve housing 118, a VVR valve 120 and a biasing member 122. The valve housing 118 may define a valve stop region 124 and an annular wall 126 located within the hub 78 of the orbiting scroll 68 and extending axially from a valve stop region 124. The valve stop region 124 may be located axially between the drive shaft 62 and the end plate 72. An annular recess 128 may be defined in an axial end of the valve stop region 124 facing the orbiting scroll 68 and may form an inner valve guide 130. The hub 78 of the orbiting scroll 68 may form an outer valve guide 132. The axial end surface of the end plate 72 of the orbiting scroll 68 defining the first and second VVR ports 112, 114 may form a valve seat 125 for the VVR valve 120.

A seal 134 may surround the annular wall 126 and may be engaged with the annular wall 126 and the hub 78 to isolate the suction pressure region of the compressor from the first and second VVR ports 112, 114 and the second discharge port 116. A drive bearing 136 may be located within the annular wall 126 the valve housing 118 and may surround the drive bushing 80 and drive shaft 62. A pin 138 may be engaged with the valve housing 118 and the hub 78 of the orbiting scroll 68 to inhibit relative rotation between the valve housing 118 and the orbiting scroll 68.

The VVR valve 120 may be located axially between the valve stop region 124 of the valve housing 118 and the valve seat 125 of end plate 72 of the orbiting scroll 68. The VVR valve 120 may include an annular body 140 radially aligned with the first and second VVR ports 112, 114, surrounding the second discharge port 116 and defining a central aperture 142 radially aligned with the second discharge port 116. The inner valve guide 130 may extend through the central aperture 142 and the outer valve guide 132 may surround an outer perimeter of the annular body 140 to guide axial displacement of the VVR valve 120 between open and closed positions. The biasing member 122 may urge the VVR valve 120 to the closed position and the VVR valve 120 may be displaced to the open position by pressurized fluid within the intermediate compression pockets via the first and second VVR ports 112, 114.

The VVR valve 120 may overlie the first and second VVR ports 112, 114 and sealingly engage valve seat 125 to isolate the first and second VVR ports 112, 114 from communication with the second discharge port 116 when in the closed position. The VVR valve 120 may be axially offset from the valve seat 125 to provide communication between the first and second VVR ports 112, 114 and the second discharge port 116 when in the open position. The first and second intermediate compression pockets may be placed in communication with the discharge pocket when the VVR valve 120 is in the open position.

More specifically, a flow path may be defined from the first and second intermediate compression pockets to the first discharge port 92 when the VVR valve 120 is in the open position. The flow path may be defined through the first and second VVR ports 112, 114 to a space between the valve housing 118 and the end plate 72 of the orbiting scroll 68 to the second discharge port 116 to the first discharge port 92.

Figure 3:
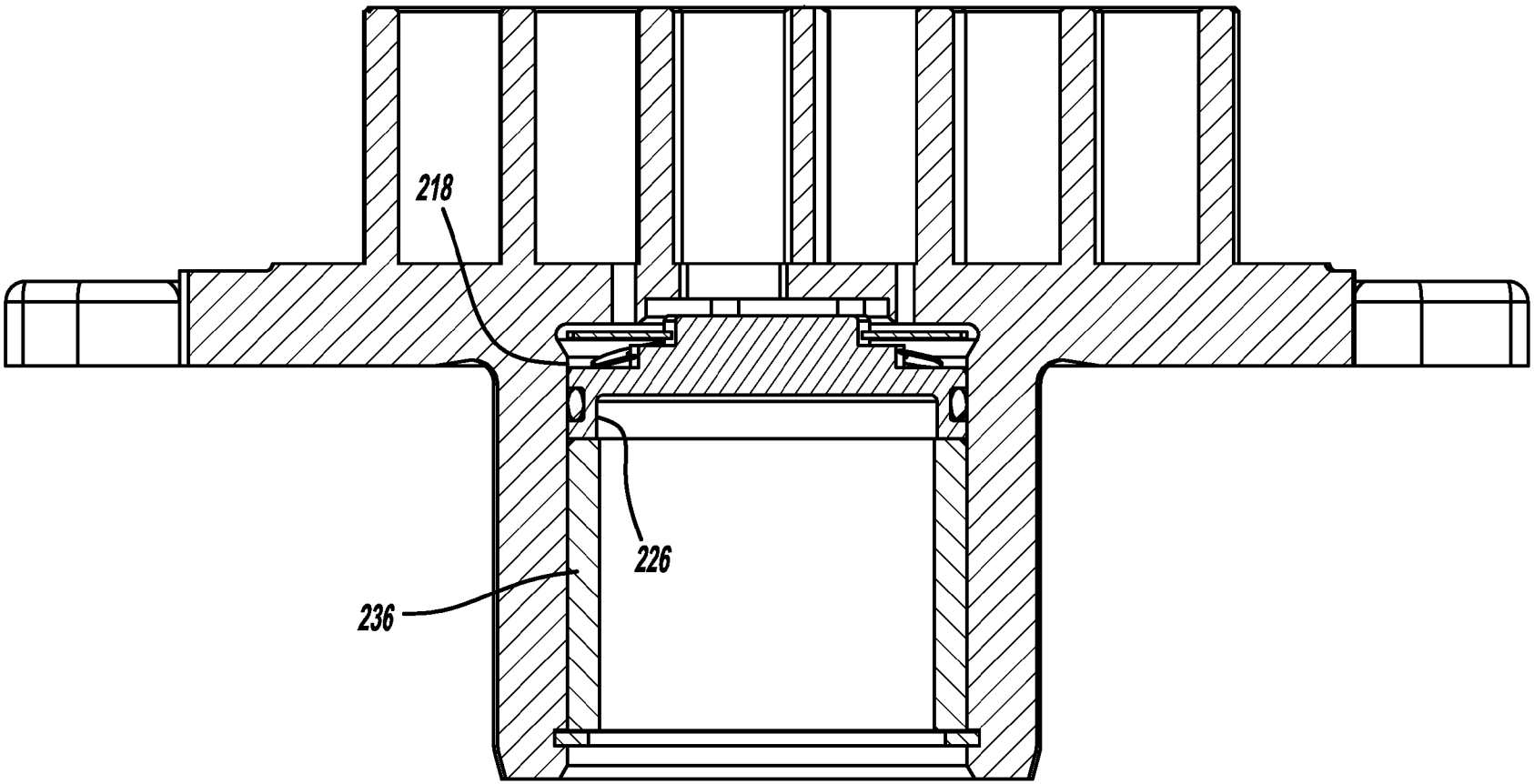
FIG. 3 is a section view illustrating an alternate compressor valve retainer arrangement according to the present disclosure.

FIG. 3 illustrates an alternate valve housing 218. The valve housing 218 may be incorporated into compressor 10 in place of the valve housing 118. In the arrangement shown in FIG. 3, the valve housing 218 may include a shortened annular wall 226 relative to the annular wall 126 shown in FIGS. 1 and 2. Therefore, the drive bearing 236 may be located at an axial end of the annular wall 226 of valve housing 218 rather than within valve housing 218.

Figure 4:
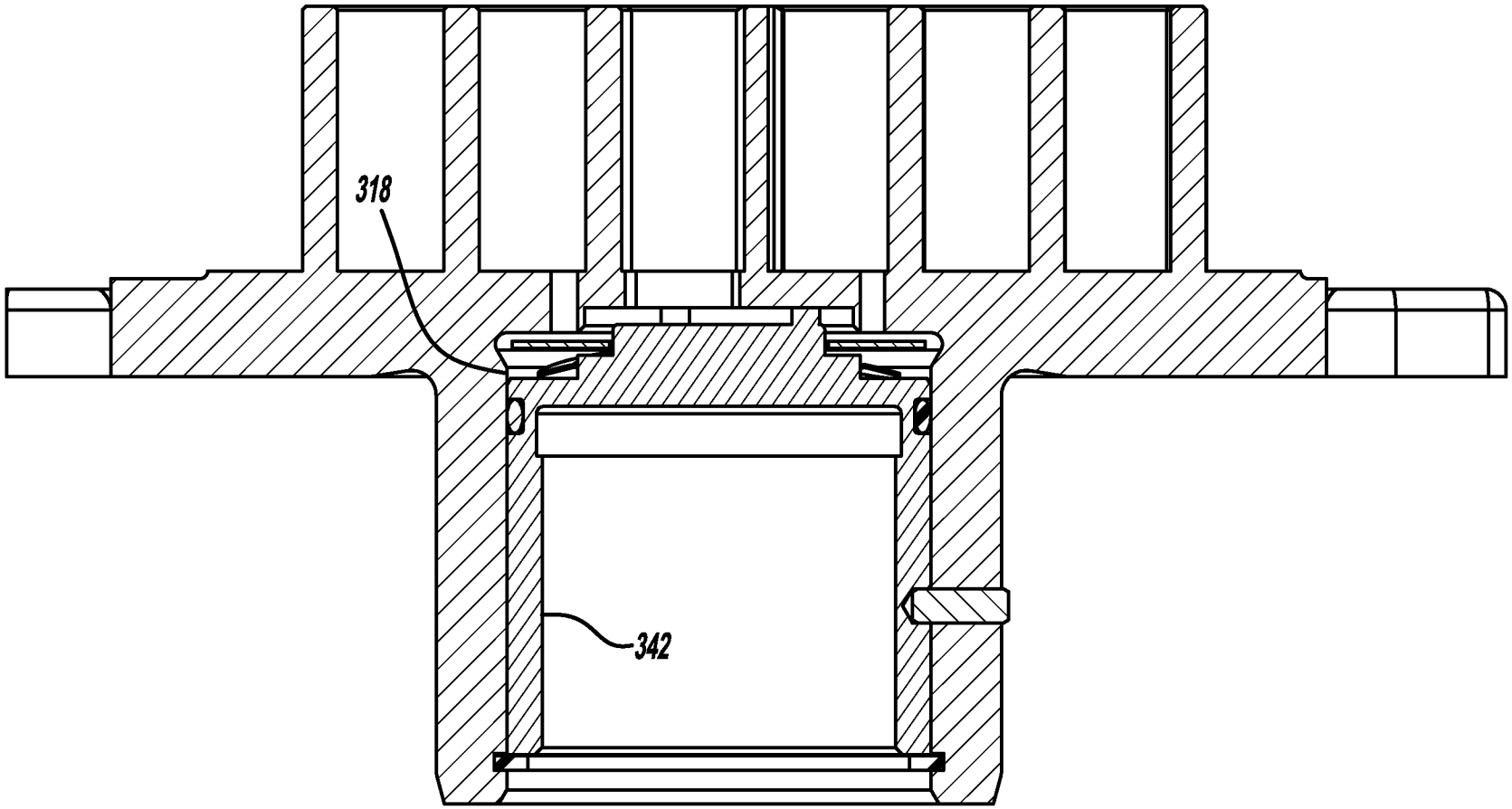
FIG. 4 is a section view illustrating an alternate compressor valve retainer arrangement according to the present disclosure.

A further alternate valve housing 318 is illustrated in FIG. 4. The valve housing 318 may be incorporated into compressor 10 in place of the valve housing 118. The valve housing 318 may be generally identical to the valve housings 118, 218 discussed above. However, instead of having a separate drive bearing 136, 236, the valve housing 318 may define a monolithic body 342 that defines both the valve housing features and the drive bearing discussed above.

In some embodiments, some or all of the monolithic body 342 may include an anti-wear coating. For example, portions of the monolithic body 342 that define the drive bearing may include the anti-wear coating. The anti-wear coating may be of the type disclosed in assignee's commonly owned U.S. application Ser. No. 13/948,458, filed Jul. 23, 2013, the disclosure of which is hereby incorporated by reference.

In some embodiments, the anti-wear coating may include a thermoplastic polymer and at least one lubricant particle. In some embodiments, the anti-wear coating may include a thermoplastic polymer, a first lubricant particle, and a second lubricant particle that is distinct from the first particle. One or a plurality of distinct layers of material can be applied to the monolithic body 342 to form the anti-wear coating. In some embodiments, the anti-wear coating may have a substantially uniform thickness of less than or equal to about 0.005 inches (about 127 μm), for example. In some embodiments, the anti-wear coating has a thickness of greater than or equal to about 0.002 inches (about 51 μm) to less than or equal to about 0.003 inches (about 76 μm), for example. Such a thin anti-wear coating on the drive bearing of the monolithic body 342 may provide the ability to eliminate traditional bearings (e.g., sleeve-type bearings and/or bushings) or alternatively, can be used with bearings and/or bushings to further improve performance. In certain alternative variations, the anti-wear coating may be used in a conventional sleeve-type bearing or bushing as the wear surface material disposed over a backing sleeve material, for example.

A precursor powder material may be applied to the monolithic body 342. The precursor powder material may include a powderized thermoplastic polymer, a first lubricant particle, and a second distinct lubricant particle. Such a powderized precursor material can be dispersed or suspended in a carrier or liquid carrier to be applied to a target surface. By "powderized" it is meant that the dry materials are pulverized or milled to provide a plurality of solid particles having a relatively small size. For example, the plurality of powder particles may have an average particle size diameter of less than or equal to about 50 μm, optionally less than or equal to about 40 μm, optionally less than or equal to about 30 μm, optionally less than or equal to about 25 μm, optionally less than or equal to about 20 μm, optionally less than or equal to about 15 μm, and in certain variations, optionally less than or equal to about 10 μm.

In some embodiments, a thermoplastic resin provides a heat-resistant and wear resistant binding matrix for the lubricant particle(s). In certain alternative embodiments discussed above, such thermoplastic resins may be used to build up a basecoat, as well. In some embodiments, one or more thermoplastic polymers may be provided in a powderized dry form. For example, a thermoplastic may include polymers from the polyaryletherketone (PAEK) family. In certain variations, the polyaryletherketone (PAEK) thermoplastic polymer can be selected from the group consisting of: a polyetherketone (PEK), polyetheretherketone (PEEK), a polyetheretheretherketone (PEEEK), polyetherketoneketone (PEKK), polyetheretherketoneketone (PEEKK) polyetherketoneetheretherketone (PEKEEK), polyetheretherketoneetherketone (PEEKEK), and combinations thereof. In other variations, the thermoplastic matrix material may comprise polyamide imide (PAI), polyphenylene sulfide (PPS), or polyimide (PI) alone or as combined with any of the other suitable thermoplastic polymers discussed just above. In certain variations, the powderized thermoplastic polymer is selected from the group consisting of: a polyaryletherketone (PAEK) or other ultra-performing polymer including, but not limited to poly(phenylene sulphide) (PPS), poly(sulphone) (PS) polyamide imide (PAI), poly(benzimidazole) (PBI), or polyimide (PI). In some embodiments, the carrier material or thermoplastic polymer may be an ultra-performance, high temperature thermoplastic resin, namely polyetheretherketone (PEEK), a member of the polyaryletherketone (PAEK) family, in a powderized form.

The lubricant particle fillers can be any number of friction/wear compounds including, but not limited to inorganic fillers, organic fillers, and polymeric particles used as fillers. A "lubricant particle" includes a solid material in particulate form (e.g., a plurality of solid particles) that contributes to a low coefficient of friction or provides additional tribological or synergistic properties to the overall anti-wear material composition. In some embodiments, the first and/or second lubricant particles of the anti-wear coating may be selected from the group consisting of: polytetrafluoroethylene (PTFE) particles (or powderized PTFE), molybdenum disulfide ($MoS_2$) particles, tungsten disulfide ($WS_2$) hexagonal boron nitride particles, carbon fibers, graphite particles, graphene particles, lanthanum fluoride, carbon nanotubes, polyimide particles (or powderized polyimide polymer), poly(benzimidazole (PBI) particles (e.g., fibers), and combinations thereof. In certain preferred variations, the first lubricant particle comprises molybdenum disulfide ($MoS_2$) and the second distinct lubricant particle comprises polytetrafluoroethylene (PTFE), such as powderized PTFE particles.

In some embodiments, a first precursor powder material may be applied to the monolithic body 342 without any lubricant particles, but including a first powderized thermoplastic polymer to form a basecoat (or multiple layers of a basecoat). A second precursor powder material can then be applied over the basecoat, which can optionally be applied in multiple coatings to form a plurality of layers of an anti-wear coating. The second precursor powder material may include a second powderized thermoplastic polymer, a first lubricant particle, and a second distinct lubricant particle, as discussed in the embodiments above.

In some embodiments, the one or more lubricant particles may include polytetrafluoroethylene (PTFE) and molybdenum disulfide ($MoS_2$), which may be selected as the friction/wear compounds to improve wear characteristics of the anti-wear coating material. PTFE can be incorporated at greater than or equal to about 5 to less than or equal to about 30% by weight, with the most preferred amount of PTFE being present at greater than or equal to about 15 to less than or equal to about 20% by weight. In some embodiments, it can be advantageous to avoid excessively high concentrations of PTFE (well in excess of 30% by weight), as PTFE forms a soft phase that can capture debris and create undesirable adhesive wear. $MoS_2$ can be incorporated at greater than or equal to about 2.5 to less than or equal to about 25% by weight, optionally at greater than or equal to about 2.5 to less than or equal to about 15% by weight, with a particularly desirable amount of $MoS_2$ being about 10% by weight. Of course, other anti-wear coatings are likewise contemplated in other embodiments of the present disclosure.

Figure 5:
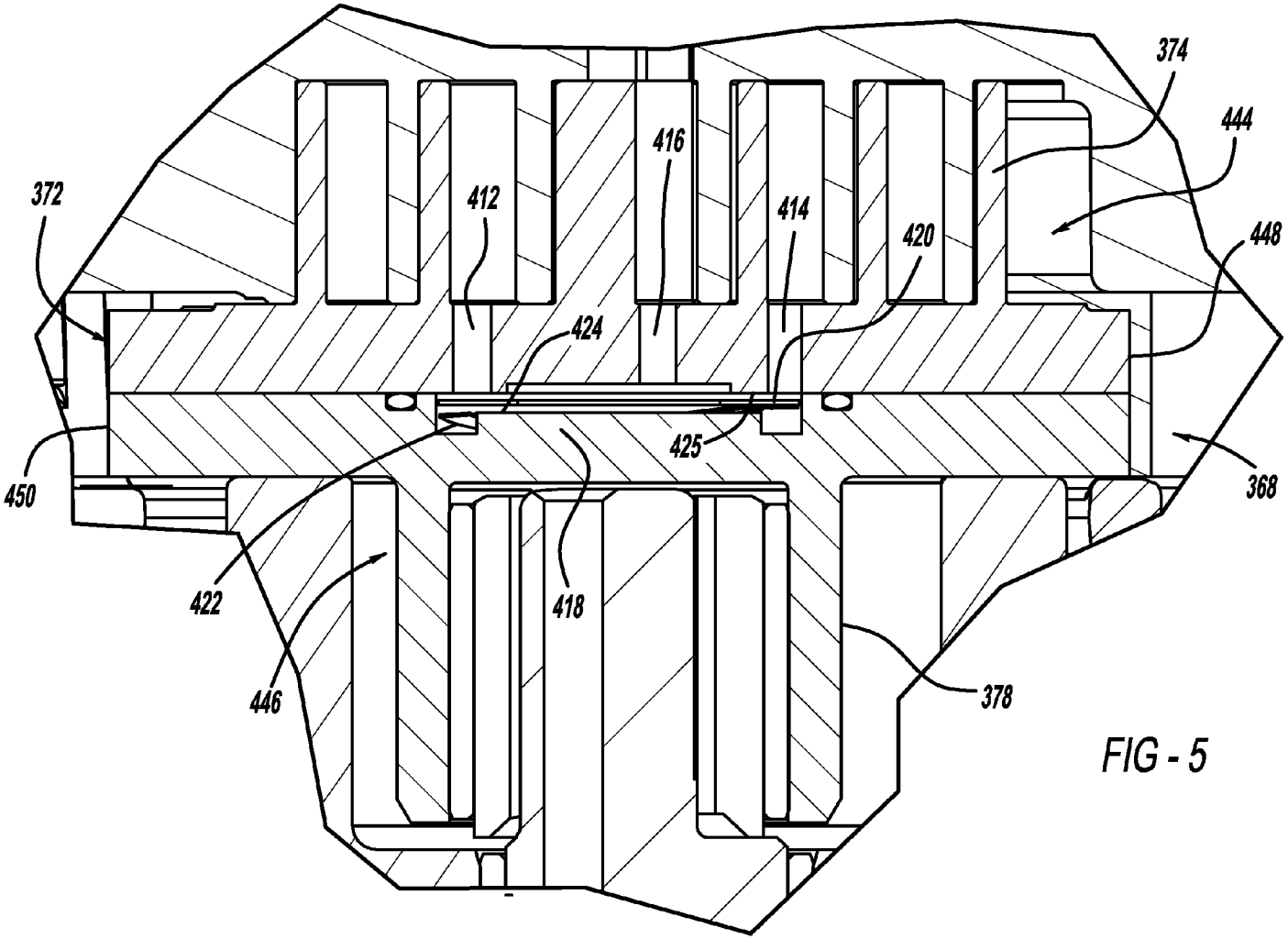
FIG. 5 is an alternate section view illustrating an alternate compressor valve retainer arrangement and orbiting scroll according to the present disclosure.

An alternate orbiting scroll 368 and VVR assembly 28 are illustrated in FIG. 5. In the arrangement shown in FIG. 5, the orbiting scroll 368 may be formed from first and second members 444, 446 coupled together. The VVR valve 420 and biasing member 422 may be retained between the first and second members 444, 446. The first member 444 may form a first portion 448 of the end plate 372 and the second member 446 may form a second portion 450 of the end plate 372. The spiral wrap 374 may extend from the first portion 448 of the end plate 372 and the first and second VVR ports 412, 414 and second discharge port 416 may be defined in the first portion 448 of the end plate 372. The first member 444 may define a valve seat 425 (similar to valve seat 125 of orbiting scroll 68 discussed above). The second member 446 may define the drive hub 378 and the valve housing 418. More specifically, the second portion 450 of the end plate 372 may define the valve stop region 424. The valve stop region 424 may be similar to the valve stop region 124 discussed above and, therefore, will not be described in detail with the understanding that the description of the valve stop region 124 applies equally to valve stop region 424.

Figure 6:
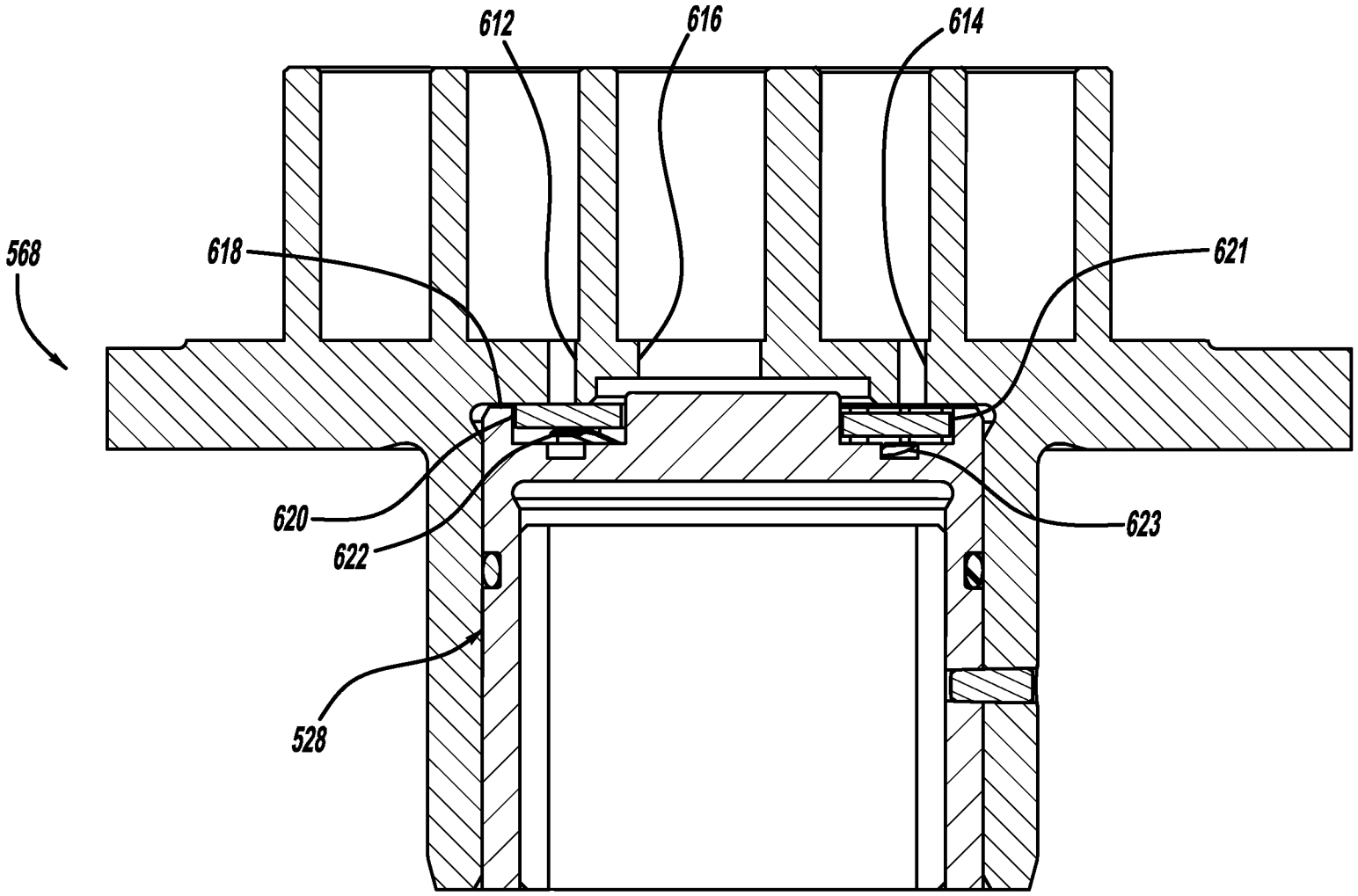
FIG. 6 is an alternate section view illustrating an alternate compressor valve retainer arrangement and orbiting scroll according to the present disclosure.
Figure 7:
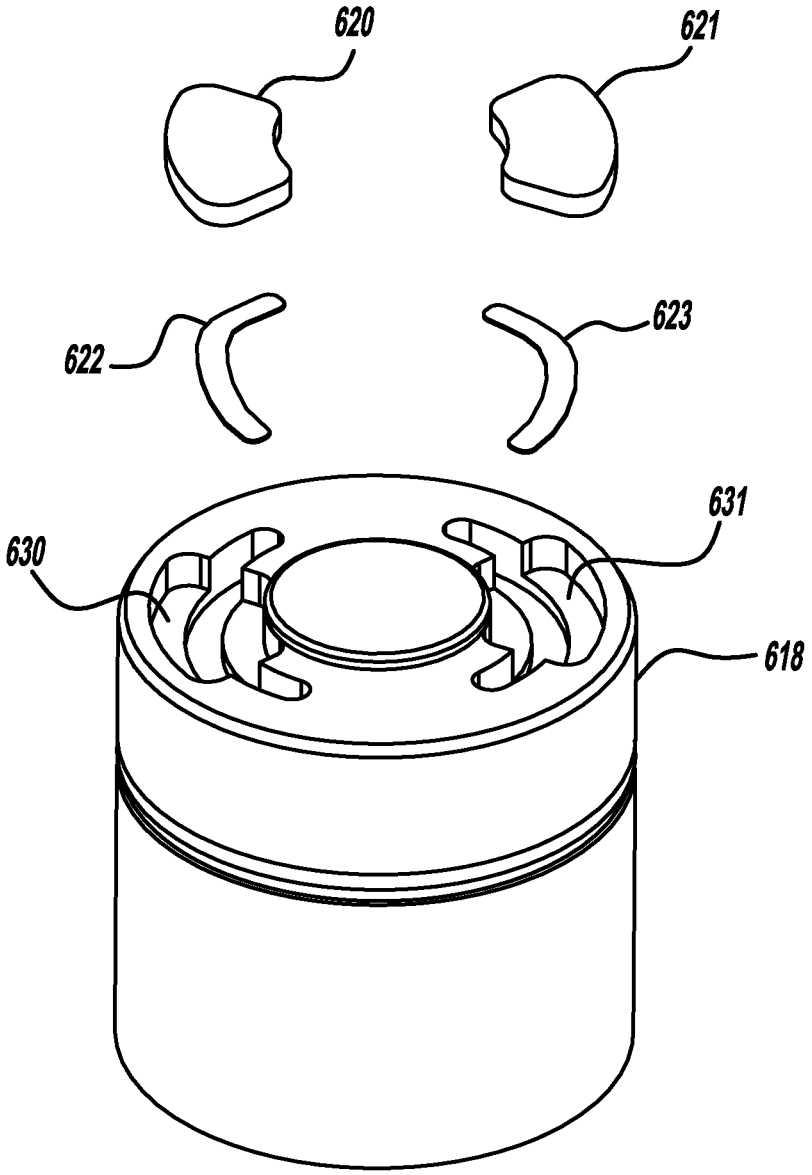
FIG. 7 is an exploded perspective view of the compressor valve retainer arrangement and valve shown in FIG. 6.

FIGS. 6 and 7 illustrate another orbiting scroll 568 and VVR valve assembly 528. The orbiting scroll 568 and VVR valve assembly 528 may be similar to the orbiting scroll 68 and VVR valve assembly 28 shown in FIGS. 1 and 2, with differences noted below.

The VVR valve assembly 528 may include first and second VVR valves 620, 621 in place of the single VVR valve 120 shown in FIGS. 1 and 2. The valve housing 618 may include a first recess 630 housing a first biasing member 622 and the first VVR valve 620 and a second recess 631 housing the second biasing member 623 and the second VVR valve 621. The first VVR valve 620 may be displaceable between open and closed positions to selectively provide communication between the first VVR port 612 and the discharge port 616. The second VVR valve 621 may also be displaceable between open and closed positions to selectively provide communication between the second VVR port 614 and the discharge port 616. The first and second VVR valves 620, 621 may be displaceable independent from one another.

What is claimed is:

1. A compressor comprising:

a first scroll member including a first end plate defining a first discharge port and a first spiral wrap extending from said first end plate;

a second scroll member including a second end plate defining a first variable volume ratio port and a second spiral wrap extending from said second end plate and meshingly engaged with said first spiral wrap and forming compression pockets, said first variable volume ratio port located radially outward relative to said first discharge port and in communication with a first compression pocket, said second end plate defining a second discharge port in selective communication with said first variable volume ratio port, said first and second spiral wraps defining a central discharge pocket in communication with said first and second discharge ports;

a drive shaft engaged with said second scroll member and driving orbital displacement of said second scroll member relative to said first scroll member; and a first variable volume ratio valve displaceable between a closed position and an open position, said first variable volume ratio valve isolating said first variable volume ratio port from said discharge pocket when in the closed position and providing communication between said first compression pocket and said discharge pocket via said first variable volume ratio port when in the open position.

2. The compressor of claim 1, wherein said second discharge port and said first variable volume ratio port define a flow path from said first compression pocket to said first discharge port when said first variable volume ratio valve is in the open position.

3. The compressor of claim 1, wherein said second scroll member includes a drive hub extending from said second end plate and engaged with said drive shaft and said first variable volume ratio valve is located within said drive hub axially between said drive shaft and said second end plate.

4. The compressor of claim 3, further comprising a valve housing located within said drive hub axially between said first variable volume ratio valve and said drive shaft.

5. The compressor of claim 4, further comprising a drive bearing surrounding an outer circumference of said drive shaft and located within an annular wall defined by said valve housing.

6. The compressor of claim 4, further comprising a drive bearing surrounding an outer circumference of said drive shaft and located at an axial end of said valve housing opposite said second end plate.

7. The compressor of claim 4, wherein said valve housing defines a drive bearing surrounding an outer circumference of said drive shaft.

8. The compressor of claim 7, wherein said drive bearing includes an anti-wear coating.

9. The compressor of claim 1, wherein said first variable volume ratio valve defines an annular body including a central aperture surrounding said second discharge port.

10. The compressor of claim 1, wherein said second scroll member includes first and second members coupled to one another with said first variable volume ratio valve located axially between the first and second members, said first member defining a first portion of said second end plate and said second spiral wrap and said second member defining a second portion of said second end plate and a drive hub extending from said second portion and engaged with said drive shaft.

11. The compressor of claim 10, wherein said first member defines said second discharge port and said variable volume ratio port and a flow path is defined between said first and second members from said first variable volume ratio port to said second discharge port when said first variable volume ratio valve is in the open position.

12. The compressor of claim 1, further comprising a a second variable volume ratio valve, said first and second variable volume ratio valves being displaceable between open and closed positions independent from one another, said second variable volume ratio valve selectively opening a second variable volume ratio port defined in said second end plate.

13. The compressor of claim 1, further comprising a bearing housing rotatably supporting said drive shaft.

14. A compressor comprising:

a first scroll member including a first end plate defining a first discharge port and a first spiral wrap extending from said first end plate;

a second scroll member including a second end plate defining a variable volume ratio port, a drive hub extending from said second end plate and a second spiral wrap extending from said second end plate opposite said drive hub and meshingly engaged with said first spiral wrap and forming compression pockets and a discharge pocket, said variable volume ratio port located radially outward relative to said first discharge port and in communication with a first compression pocket;

a variable volume ratio valve located within said drive hub and displaceable between a closed position and an open position, said variable volume ratio valve isolating said variable volume ratio port from said discharge pocket when in the closed position and providing communication between said first compression pocket and said discharge pocket via said variable volume ratio port when in the open position; and a drive shaft extending into said drive hub of said second scroll member and driving orbital displacement of said second scroll member relative to said first scroll member.

15. The compressor of claim 14, wherein said second end plate defines a second discharge port extending into said drive hub and a flow path is defined from said variable volume ratio port to said second discharge port through said drive hub when said variable volume ratio valve is in the open position.

16. The compressor of claim 14, further comprising a monolithic valve housing located within said drive hub axially between said variable volume ratio valve and said drive shaft, said monolithic valve housing defining a drive bearing having an anti-wear coating.

17. The compressor of claim 14, further comprising a bearing housing rotatably supporting said drive shaft.

18. A compressor comprising:

a first scroll member including a first end plate defining a first discharge port and a first spiral wrap extending from said first end plate;

a second scroll member including first and second members coupled to one another and forming a second end plate defining a variable volume ratio port and a second spiral wrap extending from said second end plate and meshingly engaged with said first spiral wrap and forming compression pockets and a discharge pocket, said first member defining a first portion of said second end plate and said second spiral wrap and said second member defining a second portion of said second end plate and having a drive hub extending therefrom, said variable volume ratio port extending through said first member, located radially outward relative to said first discharge port and in communication with a first compression pocket;

a variable volume ratio valve located axially between said first and second members and displaceable between a closed position and an open position, said variable volume ratio valve isolating said variable volume ratio port from said discharge pocket when in the closed position and providing communication between said first compression pocket and said discharge pocket via said variable volume ratio port when in the open position; and a drive shaft extending into said drive hub of said second scroll member and driving orbital displacement of said second scroll member relative to said first scroll member.

19. The compressor of claim 18, wherein said first member defines a second discharge port and said discharge pocket is in communication with said first and second discharge ports, said first and second members defining a flow path from said variable volume ratio port to said second discharge port when said variable volume ratio valve is in the open position.

20. The compressor of claim 18, further comprising a monolithic valve housing located within said drive hub axially between said variable volume ratio valve and said drive shaft, said monolithic valve housing defining a drive bearing having an anti-wear coating.

21. The compressor of claim 18, further comprising a bearing housing rotatably supporting said drive shaft.

* * * * *